US008826984B2

(12) United States Patent
Sanderlin et al.

(10) Patent No.: US 8,826,984 B2
(45) Date of Patent: Sep. 9, 2014

(54) METHOD AND APPARATUS OF HEAT DISSIPATERS FOR ELECTRONIC COMPONENTS IN DOWNHOLE TOOLS

(75) Inventors: Kerry L. Sanderlin, Houston, TX (US); Jimmie L. Riche, Jr., Spring, TX (US); Rocco DiFoggio, Houston, TX (US); Vaibhav Bahadur, Schenectady, NY (US)

(73) Assignee: Baker Hughes Incorporated, Houston, TX (US)

( * ) Notice: Subject to any disclaimer, the term of this patent is extended or adjusted under 35 U.S.C. 154(b) by 284 days.

(21) Appl. No.: 12/836,791

(22) Filed: Jul. 15, 2010

(65) Prior Publication Data

US 2011/0017454 A1 Jan. 27, 2011

Related U.S. Application Data

(60) Provisional application No. 61/226,535, filed on Jul. 17, 2009.

(51) Int. Cl.
*E21B 36/00* (2006.01)
*E21B 47/01* (2012.01)

(52) U.S. Cl.
CPC ..... *E21B 47/011* (2013.01)
USPC ..... 166/302; 166/57

(58) Field of Classification Search
USPC ..... 166/302, 57; 165/10, 45, 80.4, 80.5; 62/62, 259.2, 434
See application file for complete search history.

(56) References Cited

U.S. PATENT DOCUMENTS

| | | | | |
|---|---|---|---|---|
| 4,400,858 | A | 8/1983 | Goiffon et al. | |
| 4,513,352 | A * | 4/1985 | Bennett et al. | 361/700 |
| 4,568,830 | A * | 2/1986 | Stromswold et al. | 250/261 |
| 4,574,833 | A | 3/1986 | Custer | |
| 4,671,349 | A * | 6/1987 | Wolk | 165/47 |
| 5,554,897 | A | 9/1996 | Martin et al. | |
| 5,881,825 | A | 3/1999 | Collee et al. | |
| 6,221,275 | B1 * | 4/2001 | Choi et al. | 252/74 |
| 6,241,910 | B1 * | 6/2001 | Hayes | 252/70 |
| 6,261,475 | B1 * | 7/2001 | Hayes | 252/70 |
| 6,311,621 | B1 | 11/2001 | Marshall et al. | |
| 6,341,498 | B1 | 1/2002 | DiFoggio | |
| 6,625,027 | B2 | 9/2003 | Rider et al. | |
| 6,672,093 | B2 * | 1/2004 | DiFoggio | 62/259.2 |
| 6,769,487 | B2 * | 8/2004 | Hache | 166/302 |
| 6,877,352 | B1 | 4/2005 | Schlereth | |
| 6,978,828 | B1 * | 12/2005 | Gunawardana | 165/104.26 |
| 7,124,596 | B2 | 10/2006 | DiFoggio et al. | |

(Continued)

FOREIGN PATENT DOCUMENTS

JP 2000-303126 10/2000

OTHER PUBLICATIONS

"Air Data With and Without Fans".
"Biotemp- Abb Sensible Solution".
"Diffrences in Heat Build Up in Vacuum/Air/Helium".
K. Seiferlin et al., "The Effect of Soil Cementation on the Thermal Conductivity," Geophysical Research Abstracts, vol. 9, 02361, 2007.

(Continued)

*Primary Examiner* — Kenneth L Thompson
*Assistant Examiner* — Michael Wills, III
(74) *Attorney, Agent, or Firm* — Mossman, Kumar & Tyler, PC

(57) ABSTRACT

Devices and related methods for reducing a thermal loading of one or more components may include a housing having an interior for receiving the component(s), and a thermally conductive flowable material in thermal communication to the component(s).

14 Claims, 6 Drawing Sheets

(56) References Cited

U.S. PATENT DOCUMENTS

| | | | | |
|---|---|---|---|---|
| 7,246,940 | B2 | 7/2007 | Storm et al. | |
| 7,258,169 | B2 * | 8/2007 | Fripp et al. | 166/302 |
| 7,308,795 | B2 | 12/2007 | Hall et al. | |
| 7,347,267 | B2 | 3/2008 | Morys et al. | |
| 7,363,971 | B2 * | 4/2008 | Rodney et al. | 166/254.2 |
| 7,806,173 | B2 | 10/2010 | Kaul et al. | |
| 7,921,913 | B2 * | 4/2011 | Tchakarov et al. | 166/302 |
| 8,203,849 | B2 * | 6/2012 | Shibamoto | 361/790 |
| 2002/0125966 | A1 * | 9/2002 | Gunawardana et al. | 331/176 |
| 2005/0097911 | A1 * | 5/2005 | Revellat et al. | 62/259.2 |
| 2005/0151554 | A1 * | 7/2005 | Rae et al. | 324/760 |
| 2005/0151555 | A1 * | 7/2005 | Lewis et al. | 324/760 |
| 2006/0086506 | A1 * | 4/2006 | Golla et al. | 166/302 |
| 2006/0102353 | A1 * | 5/2006 | Storm et al. | 166/302 |
| 2006/0113077 | A1 * | 6/2006 | Willberg et al. | 166/280.1 |
| 2006/0191682 | A1 | 8/2006 | Storm et al. | |
| 2006/0191687 | A1 * | 8/2006 | Storm et al. | 166/302 |
| 2007/0114021 | A1 | 5/2007 | Brown et al. | |
| 2008/0041593 | A1 * | 2/2008 | Brown et al. | 166/302 |
| 2008/0223579 | A1 * | 9/2008 | Goodwin | 166/302 |
| 2009/0032259 | A1 | 2/2009 | DiFoggio et al. | |
| 2010/0024436 | A1 * | 2/2010 | DiFoggio | 62/3.2 |
| 2010/0147523 | A1 | 6/2010 | DiFoggio | |
| 2012/0048531 | A1 * | 3/2012 | Marzouk et al. | 166/57 |

OTHER PUBLICATIONS

C. Poulier et al., "Evolution of Thermophysical Characteristics in Tin Oxide: From Pressed Powder Compact to Fired Porous Body," J. Am. Ceram. Soc. 91[3] 965-969 (2008).

Focus I Beam Side A.

"Thermal Conductivity vs. Coefficient of Expansion," http://www.aps.org/publicationsapsnews/200502/forefronts.cfm.

"Piezoelectric Fans to Cool Heat-Generating Downhole Electronics".

L. Sherman,"Plastics that Conduct Heat" http://www.ptonline.com/articles/200106fa1.html.

K. Watson, The Thermal Conductivity Measurements of Selected Silicate Powers in Vacuum From 150-350K.

"Thermal Conductivity of Air vs. Temperature".

P.W. May et al., "Thermal Conductivity of CVD Diamond Fibres and Diamond Fibre-reinforced Epoxy Composites," http://www.sciencedirect.com, Diamond & Related Materials 14 (2005) 598-603.

"Thermal Conductivity of Gases with Minimum Sensitivity and ISL Gas Groups".

"Vacuum 7 Watts".

"Water Heat Pipes Above 150 C," http://www.1act.com/htwhp.html.

* cited by examiner

METHOD AND APPARATUS OF HEAT DISSIPATERS FOR ELECTRONIC COMPONENTS IN DOWNHOLE TOOLS

CROSS-REFERENCES TO RELATED APPLICATIONS

This application claims priority from U.S. Provisional Patent Application Ser. No. 61/226,535 filed on 17 Jul. 2009.

BACKGROUND OF THE DISCLOSURE

1. Field of the Disclosure

The disclosure relates to protecting heat sensitive components used in downhole applications by dissipating heat away from such components.

2. Description of the Prior Art

Wells, tunnels, and other similar holes formed in the earth may be used to access geothermal sources, water, hydrocarbons, minerals, etc. and may also be used to provide conduits or passages for equipment such as pipelines. This hole is commonly referred to as a borehole or wellbore of a well and any point within the borehole is generally referred to as being downhole. The drilling systems used to form the boreholes, to evaluate the boreholes, and evaluate the surrounding formations have deployed more electronic components into the borehole to increase the quantity and quality of the information obtained and to enhance operational efficiencies of such electronics. These electronic components may be used in devices such as communication devices, reservoir monitoring tools, Measurement While Drilling (MWD) logging tools, logging while drilling tools, wireline conveyed tools, data processors, and formation evaluation tools used for estimating one or more parameters relating to the borehole and/or the formation.

The present disclosure addresses the need to protect these and other electronic components from undesirable thermal energy loadings (e.g., self-heating of components).

SUMMARY OF THE DISCLOSURE

In aspects, the present disclosure provides an apparatus for reducing a thermal loading of one or more components used in a downhole tool. The apparatus may include a housing having an interior for receiving the component(s), and a thermally conductive flowable material in thermal communication with the component(s).

In another aspect, the present disclosure provides a method for reducing a thermal loading of one or more components of a downhole tool. The method may include placing a component or components in a housing in thermal communication with a thermally conductive flowable material.

It should be understood that examples of the more important features of the disclosure have been summarized rather broadly in order that detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

The disclosure is best understood with reference to the accompanying figures in which like numerals refer to like elements, and in which.

DESCRIPTION OF THE EMBODIMENTS OF THE DISCLOSURE

Aspects of the present disclosure may be utilized to provide a more robust thermal loading management system for downhole tools. Herein, to be "in thermal communication with" is broadly defined to include direct and indirect thermal coupling of a higher thermal energy region to a lower thermal energy region such that thermal energy may flow from the higher thermal energy region to the lower thermal energy region. Merely for ease of explanation, embodiments of the present disclosure will be discussed in the context of downhole tools. However, as will be appreciated, the present disclosure is susceptible to embodiments of different forms. That is, certain embodiments of the present disclosure may be utilized in surface, as well as sub-surface, applications. The specific embodiments of the present disclosure described herein, therefore, are presented with the understanding that the present disclosure is to be considered an exemplification of the principles of the disclosure, and is not intended to limit the disclosure to that illustrated and described herein.

Figure 1:
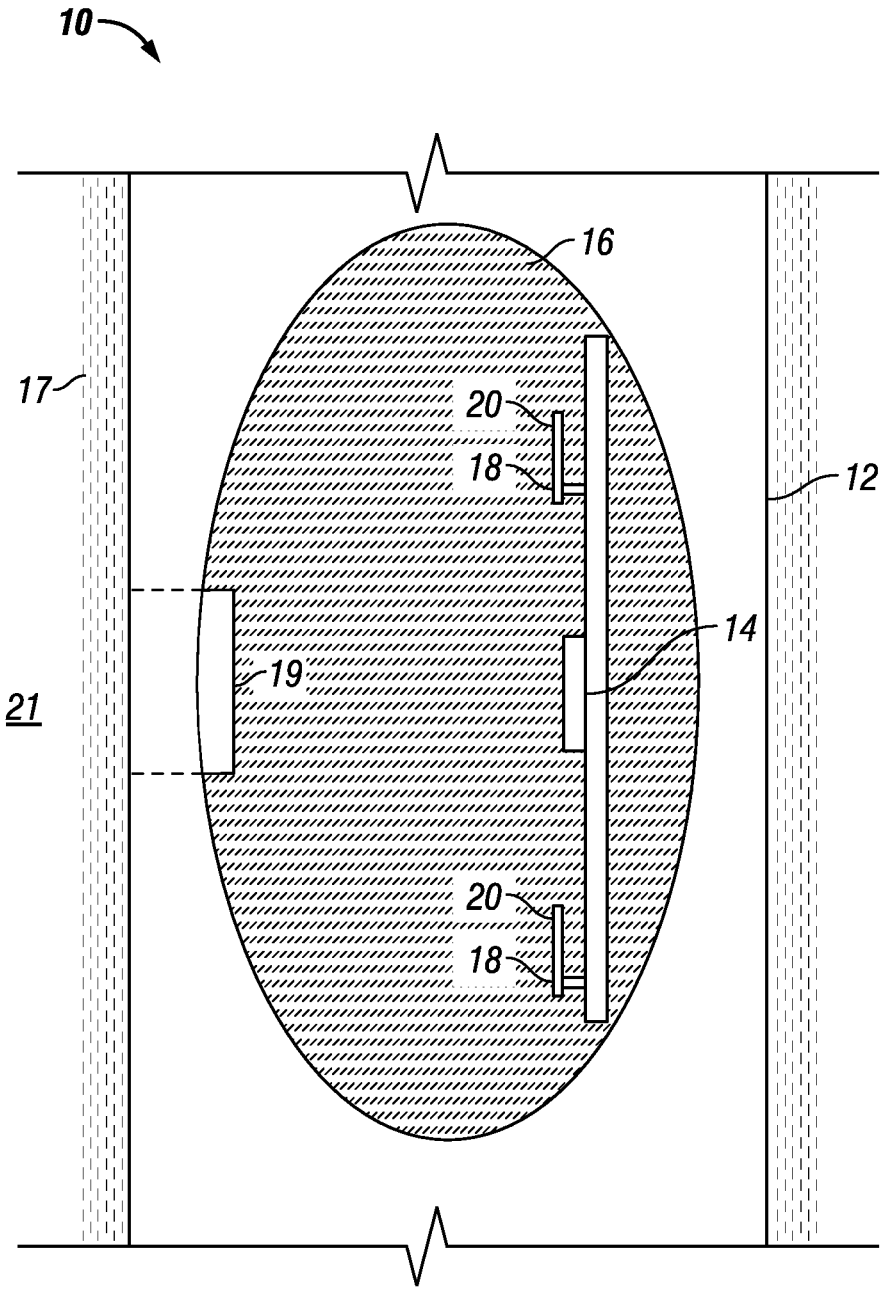
FIG. 1 schematically illustrates a borehole tool having an oval portion of a wall removed and that utilizes embodiments of heat management devices made in accordance with the present disclosure that utilize flowable materials.

Referring initially to FIG. 1, there is shown a section of a downhole tool 10 having an enclosure 12 in which one or more heat generating components 14 are positioned. The downhole tool 10 may be a logging tool, such as the logging tool 142 of FIG. 3 or the logging tool 160 of FIG. 4. An oval portion of the wall of the enclosure 12 has been removed to view of the interior of the tool 10. As mentioned previously, by "downhole tool," it is meant a tool configured to be conveyed and operated in a borehole drilled into an earthen formation. The enclosure 12 may be pressure sealed to prevent or limit fluid migration between the sealed interior 16 and an exterior 21 of the enclosure 12. In certain situations, the ambient temperature in the vicinity of the component 14 may be lower than the maximum rated operating temperature of the component 14. For instance, the maximum operating temperature of the tool 10 may be 200 degrees C. and the ambient temperature may be 180 degrees C. However, the component 14, during operation, may generate heat that increases the temperature of the component 14 by about 20 degrees C. Thus, the component 14 may be exposed to a local temperature that approaches or exceeds the maximum rated temperature of 200 degrees C. Aspects of the present disclosure reduce the thermal resistance of the path between the component 14 and a suitable heat sink (e.g., borehole fluid 17 or an adjacent component 19) such that some or most of the heat generated by the component 14 does not contribute to an undesirable self-heating of the component 14. Generally speaking, thermal resistance is the resistance of a material to heat conduction. Thermal resistance may be expressed as L/kA, measured in $K \cdot W^{-1}$ (equivalent to: ° C./W) where k is thermal conductivity, A is area, and L is thickness of a plate.

For components undergoing pulsed operation, such as pulsed lasers, there can be an additional benefit in that thermal transients are damped by any volumetric heat capacity of the filling material. This effect can be important for pulsed components that must be maintained at a fixed temperature. The corresponding thermal behavior can be modeled as if it were an electrical circuit having a resistor and capacitor in parallel between a voltage and ground and an associated time constant, wherein the heat capacity acts like an electrical capacitor except that it stores heat instead of storing charge and serves to smooth out temperature pulses. However, under steady state conditions, the system behaves like a pure resistor with no capacitive effect so that the heat capacity of the filling material is no longer important. Therefore, the choice of a flowable filling component or mixture may depend, in part, on whether the component will be pulsed or steady state and how important it is for the component to be maintained at a constant temperature. For reference, helium (0.0005567 Joule $cm^{-3}$ $K^{-1}$ at STP) and air (0.0009268 Joule $cm^{-3}$ $K^{-1}$ at STP) have much lower volumetric heat capacities than do diamond (1.78 Joule $cm^{-3}$ $K^{-1}$), BIOTEMP® (1.79 Joule $cm^{-3}$ $K^{-1}$), or water (4.19 Joule $cm^{-3}$ $K^{-1}$ at 25° C.).

In embodiments, the tool 10 may include a body 16 having one or more properties or characteristics selected to enhance operation of the component 14. Exemplary properties or characteristics of the body 16 may include, but are not limited to, a thermal conductivity value that facilitates heat flow between the component 14 and a heat sink, a chemical reactivity (e.g., reduce oxidation of solder joints, degradation of organic materials, etc.) that is sufficiently low as to not damage or degrade any part of the component 14, and/or an electrical conductivity value that prevents unintended current flow from the component 14.

Figure 1A:
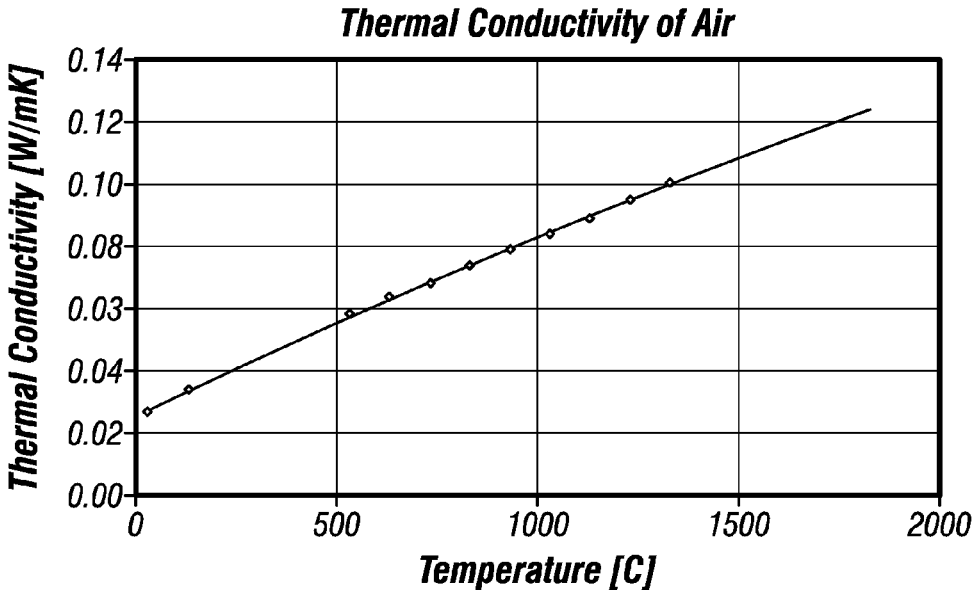
FIG. 1A is a graph of the thermal conductivity of air over a range of temperatures.

In arrangements, the body 16 and the geometry of the tool 10 may be selected to reduce the thermal resistance between the component 14, such as a computer chip or circuit board (not shown). Generally, thermal conductivity is proportional to the quantity of heat flowing between a hot surface and a cold surface divided by the temperature difference between the two surfaces. By forming the body 16 of a material having a suitably high thermal conductivity, the temperature difference may be reduced between the two surfaces, which leads to a reduction of a thermal loading or lower temperature increase for the component 14. In one arrangement, the body 16 may be formed of a material that has a thermal conductivity that is greater than that of air. By way of reference, there is shown in FIG. 1A, a thermal conductivity of air over a range of temperatures, generally reflects the data of "Conductivity of Air versus Temperature plot" of James A. Ierardi of the Department Fire Protection Engineering of Worcester Polytechnic Institute in Worcester, Mass., where $k=1.5207E\text{-}11*T^3-4.8574E\text{-}08*T^2+1.0184E\text{-}04*T-3.9333E\text{-}04$. For the purposes of the present disclosure, a thermally conductive material includes any material that has a greater value for thermal conductivity than that of air, given similar conditions (e.g., temperature). For example, at a temperature of 25 degrees C., air may have a thermal conductivity of 0.024 $Wm^{-1}K^{-1}$. Thus, one non-limiting example of a suitable material is helium, which has a thermal conductivity value of 0.142 $Wm^{-1}K^{-1}$, which is almost 6 times higher than the thermal conductivity of air. The thermal conductivity of an ideal gas is independent of pressure so, over a very wide pressure range, the thermal conductivity of helium is substantially constant. Therefore, even if some helium leaked out of a tool that had been filled with it, the thermal conductivity of the remaining helium would remain substantially the same as it had been before the leak. For convenience, referring now to FIG. 1B, there is shown a graph of the thermal conductivity of helium versus temperature, which is based on Table 29 of NSRDS-NBS-8 report. Also, the thermodynamic conductivity for helium at a given temperature may be provided by the polynomial $\lambda=0.635\times10^{-1}+0.310\times10^{-3}T-0.244\times10^{-7}T^2$, where λ is in watts per meter per degrees Kelvin and T is in degrees Kelvin. This polynomial generally provides the value of the thermal conductivity of helium in the range of 800-2100 K. For lower temperatures, one can use a table of thermal conductivities versus temperature for helium such as Table 29 of report NSRDS-NBS-8 issued by the National Institute of Standards and Technology, which is available online. As can be seen, throughout the temperature range shown, helium exhibits a thermal conductivity value that enables a greater flow of heat from the component 14 relative to air.

Figure 1B:
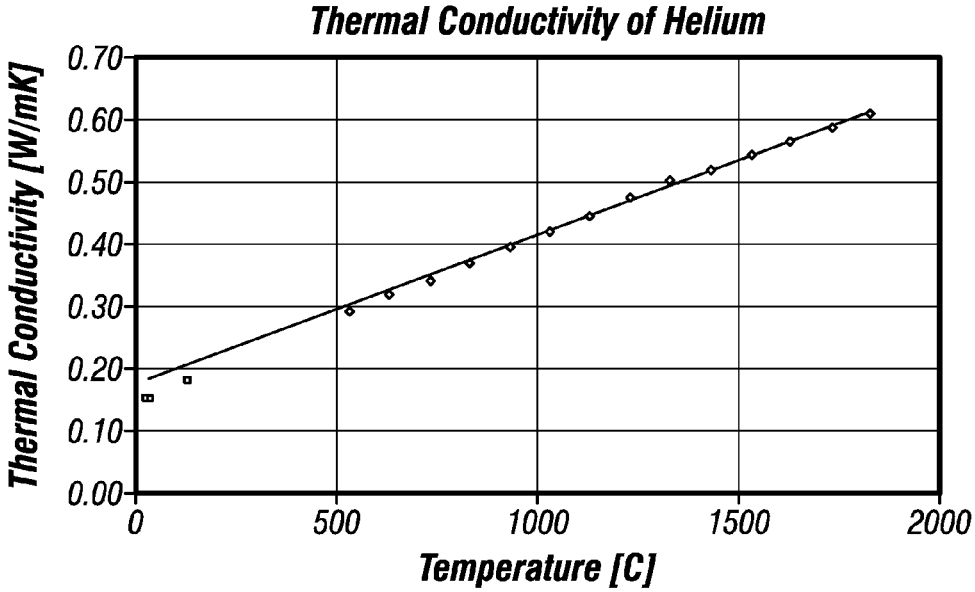
FIG. 1B is a graph of the thermal conductivity of helium over a range of temperatures.

Embodiments of the present disclosure may utilize material or materials that may have a thermal conductivity in the region between the curves of FIGS. 1A and 1B or a thermal conductivity greater than that of helium. Thus, suitable materials may include, but are not limited to, gases such as neon (0.044 $Wm^{-1}K^{-1}$) and hydrogen (0.168 $Wm^{-1}K^{-1}$) and liquids such as perfluorohexane like Fluorinert FC-43 (0.065 $Wm^{-1}K^{-1}$), triglyceride fatty acid natural esters like Envirotemp® FR3™ (0.167 $Wm^{-1}K^{-1}$) and high boiling point esters like BIOTEMP® (0.170 $Wm^{-1}K^{-1}$ at 25° C. to 0.360 $Wm^{-1}K^{-1}$ at 200° C.). Fluorinert® (BP 50-174° C.) and Novec® (BP 34-131° C.) are thermal property management fluids from 3M Corporation of St. Paul, Minn. of which FC-43 has the highest boiling point (174° C.). Envirotemp® FR3™ is available from Cooper Power Systems of Waukesha, Wis. and is triglyceride fatty acid natural ester containing a mixture of saturated and unsaturated fatty acids, which may be obtained from the seeds of soya, sunflower and rapeseed, and can be used at 300° C. BIOTEMP® is available from ABB Inc. of South Boston, Va. and is made mostly of monounsaturated high oleic acid triglyceride vegetable oils, which may be obtained from sunflower, safflower and rapeseed (canola) oil and can be used at 300° C. Envirotemp® FR3™ and BIOTEMP® have flash points greater than 300° C. so they are considered nonflammable below 300° C.

Because the electronics inside of the pressure housing of a downhole tool may not be encapsulated and may have exposed wiring, it is preferred to use an electrically non-conducting material and all of the above named fluids are electrically non-conducting. In fact, Envirotemp® FR3™ and BIOTEMP are used as transformer oils in large outdoor electrical grid power transformers that operate at more than 100 Kilovolts. If one uses a liquid, then one may need to leave a small air bubble or a small closed cell foam rubber ball inside the tool in order to take up any thermal expansion of the liquid at high temperature. If internal tool electronics are immersed in a seed oil and it later becomes necessary to rework a printed circuit board (for example, to replace a soldered component), then it should be possible to clean the boards by first wiping them with a cloth and then dipping them in a low-boiling point solvent like pentane and removing them from the solvent to dry in air.

Suitable thermally conductive materials may be a solid, liquid, or a gas. Suitable gases may include, but are not limited to, neon, helium, and hydrogen. Suitable liquids include, but are not limited to, fluorocarbons, high boiling point esters, and water. A high boiling point ester may have a boiling point of at least 200° C. Suitable liquids may have a wide range of liquidity. Suitable liquids may have melting points of about 20° C. or lower and boiling points of at least about 200° C. Suitable solid granules include, but are not limited to, granules made of aluminum oxide, aluminum nitride, diamond, and sapphire. Certain embodiments of the present disclosure may utilize mixtures or combinations of solids, liquids, and/or gases. For example, in one non-limiting example, helium may be combined with hydrogen to yield a media that would have a thermal conductivity greater than that of helium alone. The combination or mixtures may include materials in any of or all three states (solids, liquids and/or gas). In the lab, we found that replacing the air in a tool with helium or, alternatively, filling the tool with 0.9 mm diamond grit in air reduced the number of degrees of self-heating temperature rise of components by approximately 50%. Combining a helium atmosphere with 0.9 mm diamond grit reduced the number of degrees of self-heating temperature rise by approximately 85%. It should be appreciated that the addition of helium in even relatively low amounts to air increases the thermal conductivity of resulting gas mixture. Thus, it should be appreciated that two or more materials may be mixed or otherwise combined to exhibit a specified response to a thermal loading. However, in the some embodiments, any air may be completely replaced by helium. Also, in some embodiments, it may be useful to have a fluid component (a gas such as helium or a liquid such as an ester) in any flowable mixture because there will be no thermal contact resistance between either a gas or a liquid and a solid that is wet by them. This situation is different from what happens when attempting thermal transfer between two solids, where the voids created by surface roughness effects, defects, and misalignment of the interface can lead to thermal contact resistance.

In embodiments, another material property that a material making up the body 16 may have different from that of air is chemical reactivity. Air and the moisture in air tend to react with many metals and plastics especially at high temperatures. In contrast, materials, such as helium, are substantially chemically inert. Solder joints and circuit boards run to 200 degrees C. in a helium atmosphere did not show the visual degradation that is apparent when heated to the same high temperature in moist air. This could lead to greater reliability by extending the mean time between failures for the tool components. As used herein, the term chemically inert material generally refers to any material that does not substantially chemically react with another material, particularly at temperatures between about 100 degrees C. to about 300 degrees C. In one aspect, a chemical reaction may involve an exchange of ions.

Additionally, a material may have one or more properties similar to that of air. For example, a material may be electrically non-conductive. Still other aspects that may influence a selection of materials may include corrosiveness, toxicity, flammability, ease of handling, etc.

As noted above, the body 16 may be formed of a material that may be a solid, liquid, gas, or mixtures of one or more solids, liquids, and/or gases. In embodiments, the solids may be in a granular form. That is, the solid may be particulated or powderized to a degree that the solid making up the body 16 may flow in a manner similar to a liquid. As used herein, the term "granular" body generally refers to a body of solid material that can take the general shape of a container into which the solid is poured or packed. Thus, as used herein, a flowable material generally refers to a material such as a gas, liquid, and/or granular material.

In some embodiments, the granules or particles making up the granular material may all have substantially the same size, dimensions or shapes. In other embodiments, the granular material may include granules or particles having at least two or more distinct sizes, dimensions or shapes. For instance, the sizes may be selected such that particles having the smaller size may fit into the interstitial spaces separating the particles having a larger size. This may provide a greater packing density, which may increase the thermal conductivity of the body 16.

It should be understood that the flowable material need not actually flow while in the tool 10. For example, in embodiments, the granular solid may be suspended in a gel, glue, binder or other base material. For instance, the granules may be mixed into a silicone rubber compound and poured into the tool 10. The compound may solidify in place or remain in a gel or semi-solid state. Also, the granules may be coated with a cementitious material, e.g., thermal grease. One illustrative, and non-limiting, thermal grease is Dow Corning 340 Heat Sink Compound. Thus, it should be appreciated that the term "flowable material" does not require that the material be flowable while in the tool.

As shown in FIG. 1, in one embodiment, the body 16 may be formed of a flowable material that partially or completely fills the enclosure 12. Thus, the body 16, in a fluid-like manner, flows and surrounds the component 14. During one mode of operation, the body 16 is thermally coupled to the component(s) 14 such that thermal energy generated by the component(s) 14 in enclosure 12 is conducted away from the component(s) 14. The communication of thermal energy from the component(s) 14 may be direct or through one or more intermediate components.

Figure 1C:
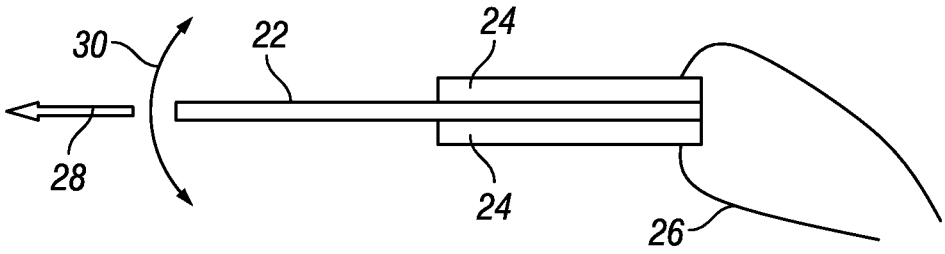
FIG. 1C schematically illustrates a fluid mover made in accordance with one embodiment of the present disclosure.

In certain embodiments, convection as well as conduction may be employed to transfer heat from the component 14 to a suitable heat sink. In one arrangement, a fluid mover 18 may be used to circulate or otherwise move the flowable material making up the body 16. For instance, the fluid mover 18 may include a fan 20 or blower to create a desired flow pattern for cooling the component 14 through convection in addition to the fluid's thermal conduction. Such a flow pattern may include, for example, directing flow so as to reduce "hot spots." Referring now to FIG. 1C, there is shown an illustrative fan 20 that may include a thin flexible blade 22 having opposing layers of piezoelectric material 24. The blade 22 may be formed of metal or other flexible or resilient material. In embodiments, the tool 10 may include two or more fluid movers 18, each of which are positioned to induce a fluid flow 28 along a long axis of the tool 12. Of course, any other flow pattern may be induced by appropriate placement of the fluid movers 18. During operation, a periodic low voltage source tuned to the resonant frequency of the piezoelectric fan blade may be applied to the fan 20 via suitable conductors 26. In response, the blade vibrates or oscillates as shown by arrow 30 to move the surrounding fluid body in the direction 28. In another arrangement, the fluid mover 18 may be formed as a rotary fan. The fluid mover 18 may be energized by a suitable energy source (not shown). A piezoelectric fan, however, may consume only microwatts of power. The fluid mover 18 may be configured to operate continuously or when one or more conditions are present; e.g., an ambient temperature reaches a preset threshold value.

Figure 2A:
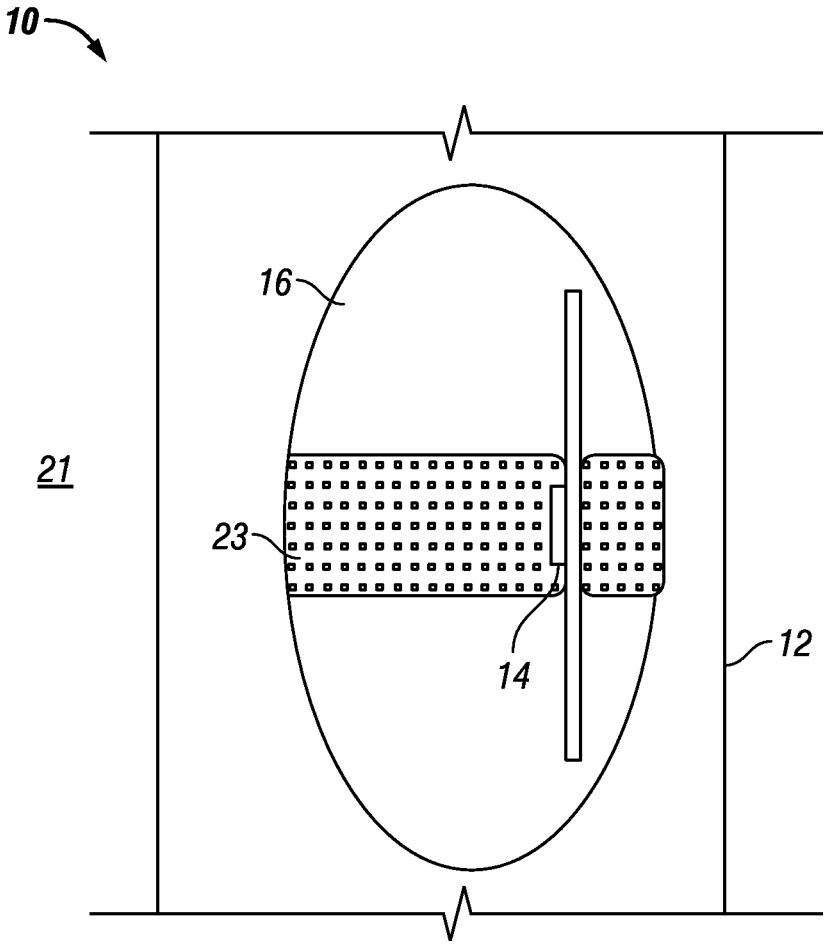
FIG. 2A schematically illustrates a borehole tool having an oval portion of a wall removed and that utilize embodiments of heat management devices made in accordance with the present disclosure that hold the flowable material in a container.

Referring now to FIG. 2A, the body 16 may be formed of a flowable material that may be confined within a bag or other suitable container 23. The container(s) 23 may be packed into the enclosure 12 to form a thermally conductive path between the component 14 and a suitable heat sink. As shown, the containers 23 are packed into an area adjacent to the component 14, but do not otherwise fill the enclosure 12. While a fluid mover is not shown, one or more fluid movers may also be utilized in the FIG. 2A embodiment. The container (s) 23 may include a liquid and/or a solid. Also, the FIG. 2A embodiment may utilize a liquid and/or a gas in the enclosure 12, in conjunction with the flowable material in the container(s) 23.

Figure 2B:
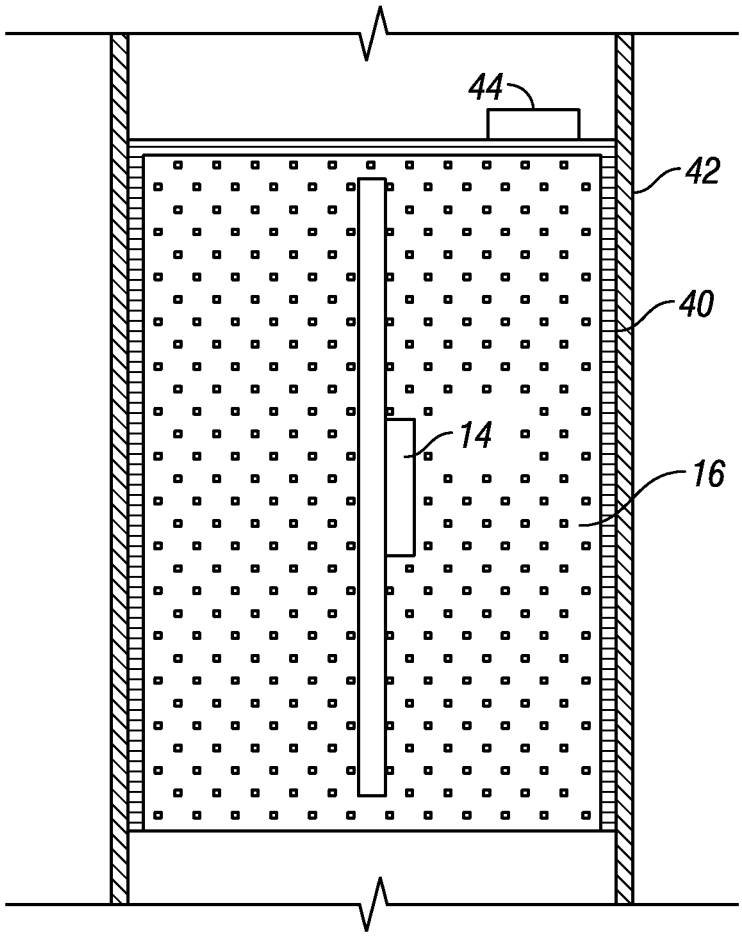
FIG. 2B schematically illustrates sectional view of a portion of a borehole tool made in accordance with one embodiment of the present disclosure that hold the flowable material and a electrical component in a container.

Referring now to FIG. 2B, there is shown a section view of a downhole tool. In the FIG. 2B embodiment, the body 16 may be formed of a flowable material that may be confined within a fillable container 40. The container 40 may be positioned inside a pressure housing 42 or formed integrally with the pressure housing 42. The container 40 may include a removable fill cap 44 that, upon removal, allows a flowable material to be poured into the container 40. The container 40 may be shaped to allow the body 16 to form a thermally conductive path between the component 14 and a suitable heat sink, such as a borehole fluid. The walls of the container 40 may be formed of a fluid impermeable material or a wire mesh material, depending on whether the body 16 is formed of a liquid or a gas.

Additionally, thermal resistance may be further reduced by increasing the surface area inside the enclosure 12 that is in contact with the body 16. For example, heat fins (not shown) may be positioned in the interior of body 16. Also, an interior surface (not shown) may be roughened to increase an available surface area for heat conduction. Further, heat sinks (not shown) may be positioned in the enclosure to further draw heat away from the component 16.

Figure 3:
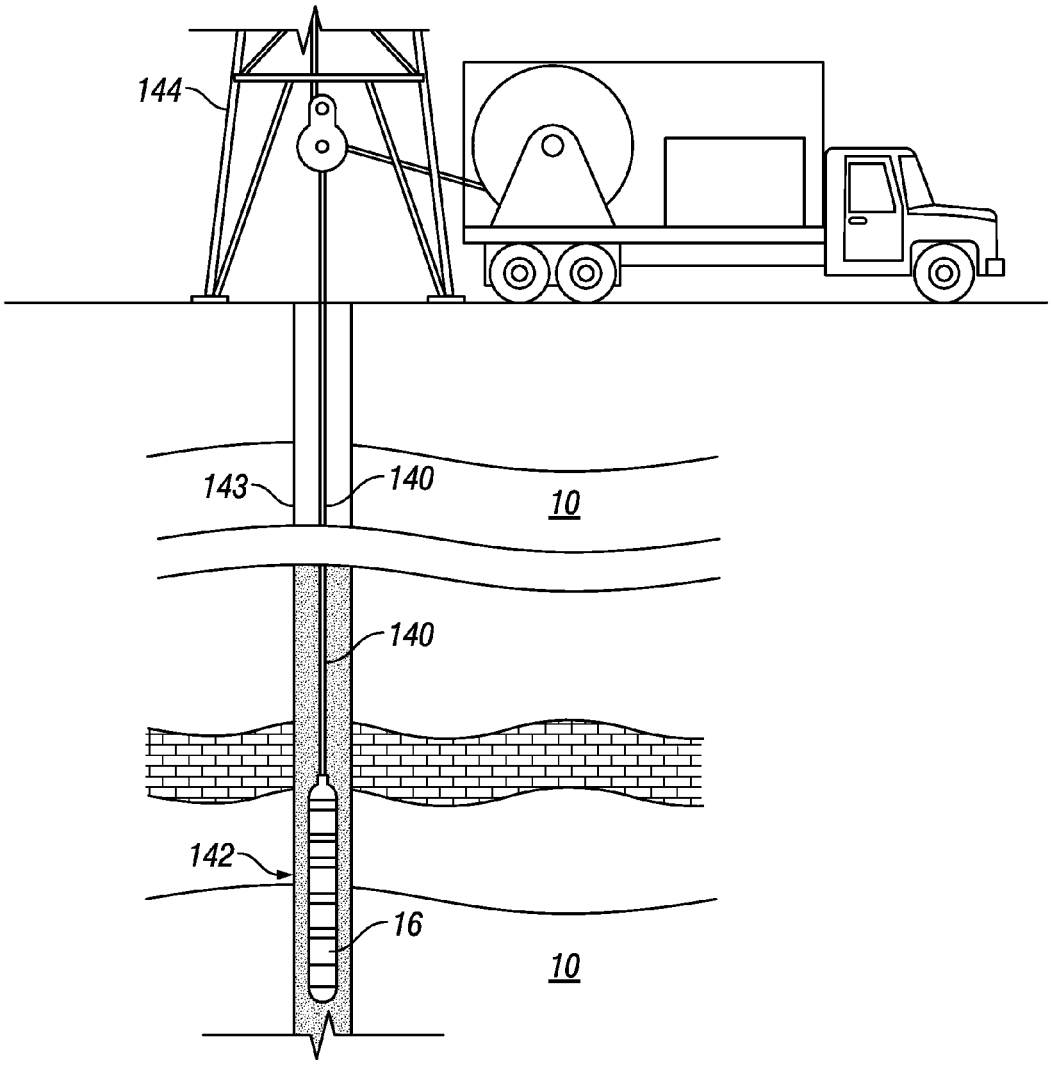
FIG. 3 schematically illustrates a tool string deployed via a non-rigid carrier into a borehole that may utilize embodiments of heat management devices made in accordance with the present disclosure and FIG. 4 schematically illustrates a tool string deployed via a rigid carrier into a borehole that may utilize embodiments of heat management devices made in accordance with the present disclosure.
Figure 4:
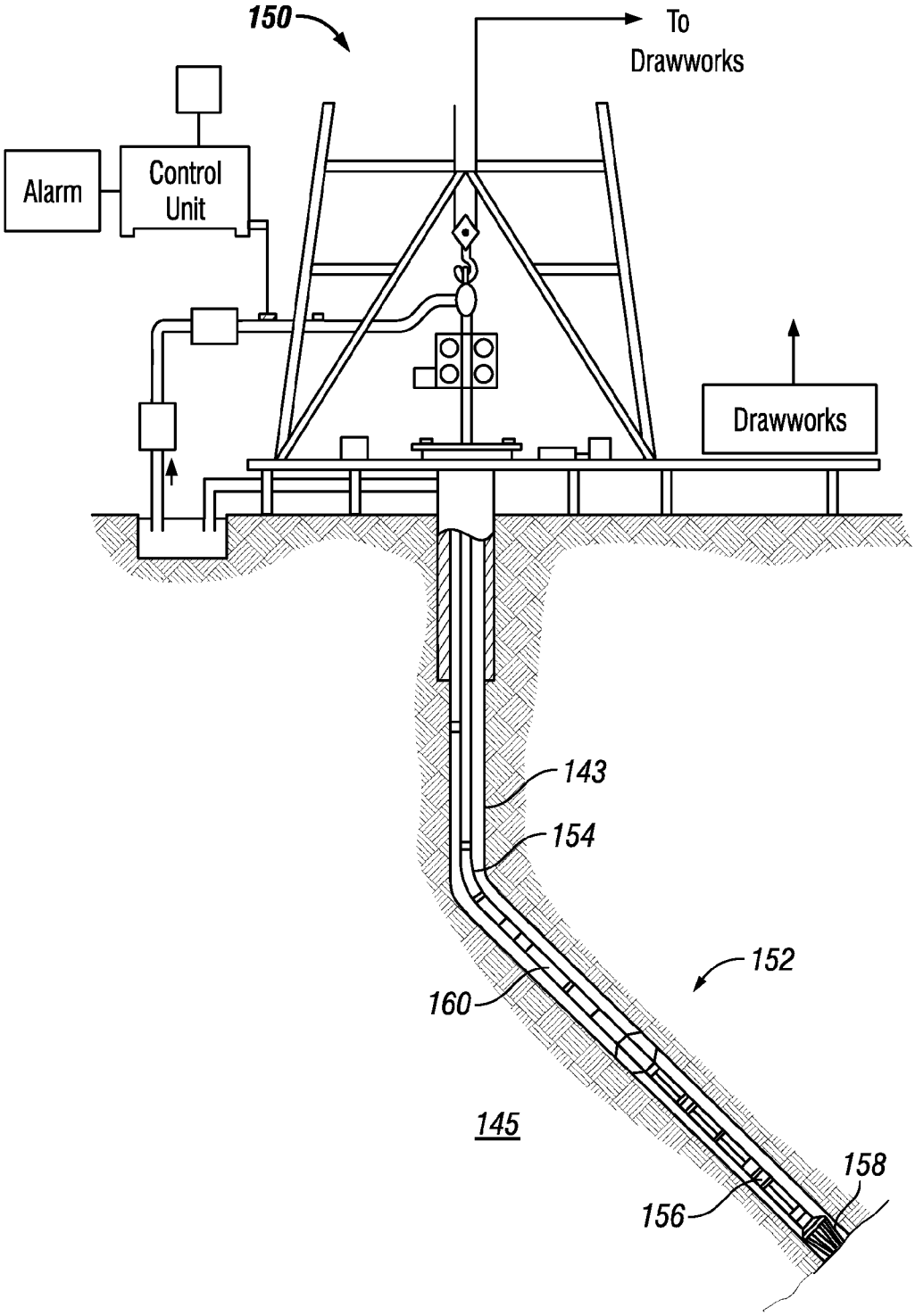

The teachings of the present disclosure may be applied to a variety of applications both at surface and for borehole operations. FIGS. 3 and 4 generally illustrate exemplary uses within a borehole environment. It should be understood, however, that the uses described below are illustrative and not limiting. That is, embodiments according to the present disclosure may be utilized in connection with communication devices, reservoir monitoring tools, permanently installed devices, and/or devices that are generally stationary for a period of time. Moreover, embodiments of the present disclosure may be used in connection with forming wells, tunnels, and other similar holes for accessing geothermal sources, water, hydrocarbons, minerals, etc. and may also be used to provide conduits or passages for equipment such as pipelines.

Referring now to FIG. 3, there is shown a non-rigid carrier 140, which may be a wireline or a slick-line, conveying a logging tool 142 having sensors, solenoids, motors, and electronics protected by one or more thermal management devices into the well bore 143. The wireline 140 is suspended in the borehole 143 from a rig 144. The logging tool 142 may include formation evaluation tools adapted to measure one or more parameters of interest relating to the formation or the borehole 143, e.g., tools that collect data about the various characteristics of the formation, directional sensors for providing information about the tool orientation and direction of movement, formation testing sensors for providing information about the characteristics of the reservoir fluid and for evaluating the reservoir conditions. The heat sensitive components of the logging tool 142 may also incorporate a body 16 in accordance with the present disclosure. In typical wireline investigation operations, the body 16 may be useful to ensure that the heat is effectively drawn away from electronic components in the logging tool 142 and a more uniform temperature regime is maintained in the logging tool 142. Thus, the heat is transferred out of the logging tool 142 and into the surrounding borehole fluids. The heat may also be transferred to other areas or components within the tool 142.

Referring now to FIG. 4 there is schematically illustrated a drilling system utilizing a thermal management system according to aspects of the present disclosure. While a land system is shown, the teachings of the present disclosure may also be utilized in offshore or subsea applications. In FIG. 4, an earth formation 145 is intersected by a borehole 143. A drilling system 150 having a bottom hole assembly (BHA) or drilling assembly 152 is conveyed via a tubing 154 into the borehole 143 formed in the formation 145. The tubing 154 may include a rigid carrier, such as jointed drill pipe or coiled tubing, and may include embedded conductors for power and/or data for providing signal and/or power communication between the surface and downhole equipment. The BHA 152 may include a drilling motor 156 for rotating a drill bit 158. The BHA 152 also includes a logging tool 160, which may include a suite of tool modules, that obtain information relating to the geological, geophysical, and/or petrophysical characteristics of the formation 145 being drilled.

The logging tool 160 may include formation evaluation tools adapted to measure one or more parameters of interest relating to the formation or the borehole 143. The BHA 152 as well as the logging tool 160 may include heat sensitive components. Such components include those that incorporate transistors, integrated circuits, resistors, capacitors, and inductors, as well as electronic components such as sensing elements, including accelerometers, magnetometers, photomultiplier tubes, and strain gauges, and electrical components such as solenoids and motors. The BHA 152 may also include communication devices, transmitters, repeaters, processors, power generation devices, or other devices that may incorporate heat sensitive components. The thermal management systems provided by the present disclosure, such as those shown in the Figures, may be utilized to protect these components from applied thermal loadings originating in the heat generated by the electronic components themselves.

It should therefore be appreciated that embodiments of the present disclosure relate to devices and methods that utilize conduction and/or convection to draw heat from heat sensitive components. The term "heat sensitive component" generally refers to any tool, electrical component, sensor, electronic instrument, structure, or material that degrades either in performance, structural integrity, operating efficiency, operating life, or reliability when encountering a thermal loading outside of the operating norm for that component. The heat sensitive component may or may not generate heat (or "self-heat") during operation.

From the above, it should be appreciated that what has been described includes, in part, an apparatus for reducing a thermal loading of one or more components used in a downhole tool. The apparatus may include a housing having an interior for receiving the component(s); and a body including a thermally conductive flowable material in thermal communication to the component(s). In one embodiment, the flowable material may be a fluid. The fluid may also be a gas, and/or a combination of at least two gases. The fluid may also be a liquid, and/or a combination of at least two liquids. In one arrangement, the material may include at least helium. In another arrangement, the material may include one or more of: a fluorocarbon, a high boiling point ester, and water. Also, the material may be granular. The granular material may include diamonds, sapphires, aluminum nitride, aluminum oxide, and/or boron nitride. Also, the granular material may include granules having at least predetermined two sizes. In certain applications, the body may include a suspension medium in which the granular flowable material is suspended. In further embodiments, the apparatus may include a fluid mover configured to generate a predetermined flow of the flowable material. The fluid mover may include a piezoelectric element. In embodiments, the thermally conductive flowable material has a thermal conductivity value that is greater than a thermal conductive value of air. Also, the chemical reactivity of the flowable material may be less than a chemical reactivity of air.

From the above, it should be appreciated that what has been described includes, in part, a method for reducing a thermal loading of one or more components of a downhole tool. The method may include thermally coupling a component or components in a housing to a thermally conductive flowable material.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. It is intended that the following claims be interpreted to embrace all such modifications and changes.

We claim:

1. An apparatus for use in a wellbore, comprising:

a housing of a downhole tool having an interior for receiving at least one self-heating component; and a non-circulating thermally conductive flowable material at least partially filling the interior of the housing, the flowable material being in direct thermal communication with the at least one self-heating component, wherein the flowable material surrounds the at least one self-heating component and conducts thermal energy from the at least one self-heating component to a heat sink, wherein the thermally conductive flowable material includes at least helium.

2. The apparatus of claim 1 wherein the flowable material is includes an electrically non-conductive fluid.

3. The apparatus of claim 1 wherein the flowable material includes a mixture of at least two gases.

4. The apparatus of claim 1 wherein the flowable material further includes one of (i) a liquid, and (ii) a mixture of at least two liquids.

5. The apparatus of claim 1 wherein the thermally conductive flowable material has a thermal conductivity value that is greater than a thermal conductivity value of air.

6. The apparatus of claim 1 wherein a chemical reactivity of the flowable material is less than a chemical reactivity of air.

7. The apparatus of claim 1, wherein the housing is sealed.

8. The apparatus of claim 1, wherein the flowable material does not cool the at least one component below an ambient temperature at the downhole tool.

9. An apparatus for use in a wellbore, comprising:

a housing of a downhole tool having an interior for receiving at least one self-heating component; and a non-circulating thermally conductive flowable material in direct thermal communication with the at least one self-heating component, wherein the flowable material is granular and is flowable in the housing and conducts thermal energy from the at least one self-heating component to a heat sink, wherein the flowable material includes at least one of: (i) diamond, (ii) sapphire, (iii) aluminum nitride, (iv) aluminum oxide, and (v) boron nitride.

10. The apparatus of claim 9 wherein the granular flowable material includes granules having at least two predetermined sizes.

11. The apparatus of claim 9 further compromising a suspension medium in which the granular flowable material is suspended.

12. A method for using a downhole tool, comprising:

reducing a temperature surrounding at least one self-heating component in the downhole tool to between an ambient temperature at the downhole tool and a maximum operating temperature of the downhole tool by placing a thermally conductive flowable material in direct thermal communication with the at least one self-heating component, wherein the flowable material surrounds the at least one self-heating component and is not circulated, wherein the flowable material has a thermal conductivity that is greater than the thermal conductivity of air.

13. The method of claim 12, further comprising primarily conducting heat away from the at least one self-heating component.

14. The method of claim 12, further comprising reducing the temperature surrounding the self-heating component to no lower than the ambient temperature at the downhole tool.

* * * * *